US007234844B2

(12) United States Patent
Bolta et al.

(10) Patent No.: US 7,234,844 B2
(45) Date of Patent: Jun. 26, 2007

(54) LIGHT EMITTING DIODE (L.E.D.) LIGHTING FIXTURES WITH EMERGENCY BACK-UP AND SCOTOPIC ENHANCEMENT

(75) Inventors: Charles Bolta, 625 Mathews St., Ft. Collins, CO (US) 80524; Phillip C. Watts, Longmont, CO (US)

(73) Assignee: Charles Bolta, Boulder, CO (US)

( * ) Notice: Subject to any disclaimer, the term of this patent is extended or adjusted under 35 U.S.C. 154(b) by 48 days.

(21) Appl. No.: 10/732,105

(22) Filed: Dec. 10, 2003

(65) Prior Publication Data

US 2004/0120152 A1 Jun. 24, 2004

Related U.S. Application Data

(60) Provisional application No. 60/432,429, filed on Dec. 11, 2002.

(51) Int. Cl.
*F21V 29/00* (2006.01)

(52) U.S. Cl. ..... 362/294; 362/249; 362/346

(58) Field of Classification Search ..... 362/294, 362/373, 800, 235, 252, 249
See application file for complete search history.

(56) References Cited

U.S. PATENT DOCUMENTS

| | | | | |
|---|---|---|---|---|
| 6,220,722 | B1 * | 4/2001 | Begemann | 362/231 |
| 6,244,728 | B1 * | 6/2001 | Cote et al. | 362/249 |
| 6,318,886 | B1 * | 11/2001 | Stopa et al. | 362/555 |
| 6,499,860 | B2 * | 12/2002 | Begemann | 362/230 |
| 6,682,211 | B2 * | 1/2004 | English et al. | 362/545 |
| 2004/0001344 | A1 * | 1/2004 | Hecht | 362/555 |

* cited by examiner

*Primary Examiner*—Thomas M. Sember
(74) *Attorney, Agent, or Firm*—Emery L. Tracy

(57) ABSTRACT

An L.E.D. lighting fixture is provided. The lighting fixture comprises at least one heat transfer mounting bar, at least one emitter plate secured to the mounting bar, and an array of L.E.D. lights secured to each emitter plate. A method for providing light is also provided.

33 Claims, 18 Drawing Sheets

Single Tee Mounting Bar

Single Tee Mounting Bar

Single Tee Mounting Bar with Angled Base

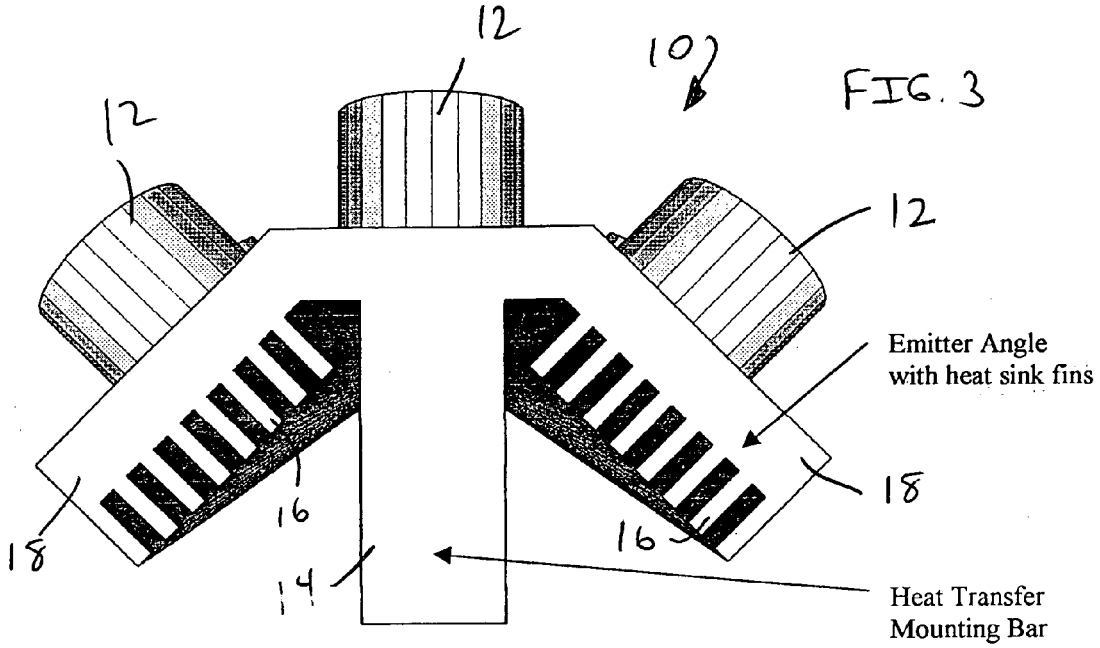
Single Tee Mounting Bar with Multiple Angled Emitter Plates
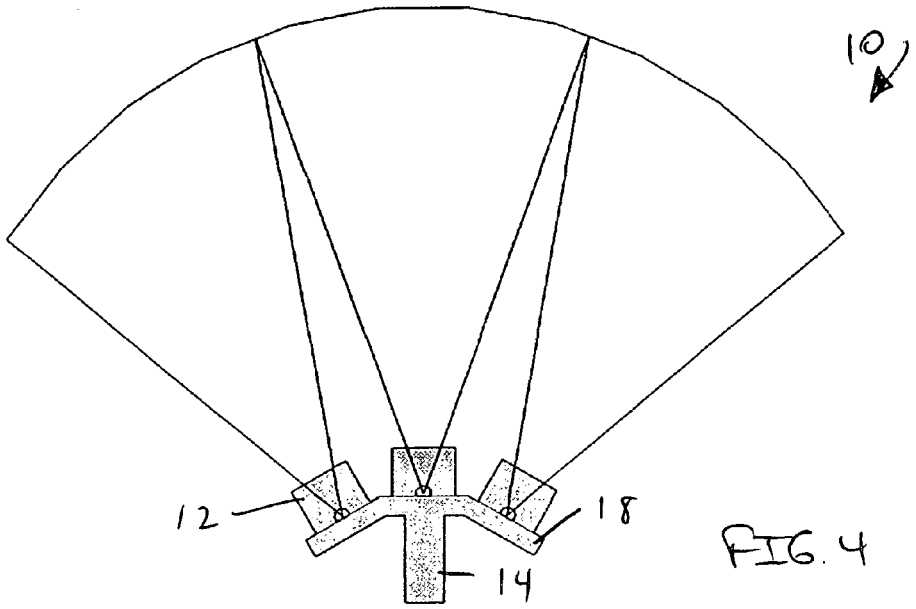
Light Distribution Diagram

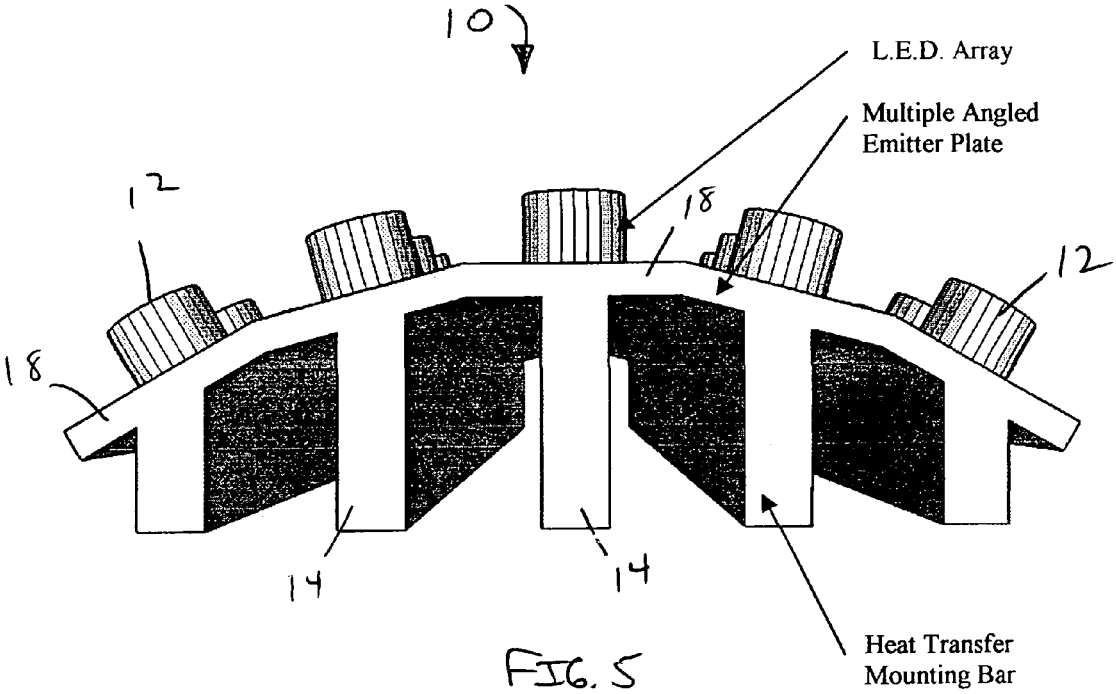
Drawing 3 - Mounting Bar and Mulitple Angled Emitter Plate Assembly

- Active Cooling by Fan and Staggered Air Channels

Drawing 5 - Filler Emitter Plates

Drawing 6 – Light Distribution Diagram

Monolithic Mounting Bar and Arc Shaped Emitter Plate

Drawing 7.1 - Recessed L.E.D. Array

36

Interior Chrome Lens Cupp

30

Lens Bar

30

15° degree Angle Prismatic Lens

Drawing 10 - Plastic Diffusion Lens

Drawing 12 – 360 Degree Tube Fixture

MR16 Type Reflector

Drawing 14 - Integrated Heat Sink Design

10

L.E.D. Lighting Fixture

10

Blue and White L.E.D. Array

42

Varied Angle Lens

Varied Angle Lens Detail

Varied Angle Lens

Varied Angle Lens Detail

LIGHT EMITTING DIODE (L.E.D.) LIGHTING FIXTURES WITH EMERGENCY BACK-UP AND SCOTOPIC ENHANCEMENT

The present application is a continuation and claims priority of pending provisional patent application Ser. No. 60/432,429, filed on Dec. 11, 2002, entitled "Light Emitting Diode (L.E.D.) Lighting Fixtures with Emergency Back-Up and Scotopic Enhancement".

BACKGROUND OF THE INVENTION

1. Field of the Invention

This invention relates generally to light emitting diode lighting fixtures and, more particularly, the invention relates to light emitting diode lighting fixtures with emergency back-up and scotopic enhancement.

2. Description of the Prior Art

Although receptive field sizes account for some of the differences in visual sensitivity across the retina, the sensitivity at a given retinal location can also vary. The human eye can process information over an enormous range of luminance (about twelve (12) log units). The visual system changes its sensitivity to light; a process called adaptation, so that it may detect the faintest signal on a dark night and yet not be overloaded by the high brightness of a summer beach scene. Adaptation involves four major processes:

1. Changes in Pupil Size. The iris constricts and dilates in response to increased and decreased levels of retinal illumination. Iris constriction has a shorter latency and is faster (about 0.3 s) than dilation (about 1.5 s). There are wide variations in pupil sizes among individuals and for a particular individual at different times. Thus, for a given luminous stimulus, some uncertainty is associated with an individual's pupil size unless it is measured. In general, however, the range in pupil diameter for young people may be considered to be from two (2) mm for high levels to eight (8) mm for low levels of retinal illumination. This change in pupil size in response to retinal illumination can only account for a 1.2 log unit change in sensitivity to light. Older people tend to have smaller pupils under comparable conditions.

2. Neural Adaptation. This is a fast (less than one (1 s) second) change in sensitivity produced by synaptic interactions in the visual system. Neural processes account for virtually all the transitory changes in sensitivity of the eye where cone photopigment bleaching has not yet taken place (discussed below)—in other words, at luminance values commonly encountered in electrically lighted environments, below about 600 cd/m$^2$. Because neural adaptation is so fast and is operative at moderate light levels, the sensitivity of the visual system is typically well adjusted to the interior scene. Only under special circumstances in interiors, such as glancing out a window or directly at a bright light source before looking back at a task, will the capabilities of rapid neural adaptation be exceeded. Under these conditions, and in situations associated with exteriors, neural adaptation will not be completely able to handle the changes in luminance necessary for efficient visual function.

3. Photochemical Adaptation. The retinal receptors (rods and cones) contain pigments which, upon absorbing light energy, change composition and release ions which provide, after processing, an electrical signal to the brain. There are believed to be four photopigments in the human eye, one in the rods, and one each in the three cone types. When light is absorbed, the pigment breaks down into an unstable aldehyde of vitamin A and a protein (opsin) and gives off energy that generates signals that are relayed to the brain and interpreted as light. In the dark, the pigment is regenerated and is again available to receive light. The sensitivity of the eye to light is largely a function of the percentage of unbleached pigment. Under conditions of steady brightness, the concentration of photopigment is in equilibrium; when the brightness is changed, pigment is either bleached or regenerated to reestablish equilibrium. Because the time required to accomplish the photochemical reactions is finite, changes in the sensitivity lag behind the stimulus changes. The cone system adapts much more rapidly than does the rod system; even after exposure to high levels of brightness, the cones will regain nearly complete sensitivity in ten (10 min) minutes–twelve (12 min) minutes, while the rods will require sixty (60 min) minutes (or longer) to fully dark-adapt.

4. Transient Adaptation. Transient adaptation is a phenomenon associated with reduced visibility after viewing a higher or lower luminance than that of the task. If recovery from transient adaptation is fast (less than one (1 s) second), neural processes are causing the change. If recovery is slow (longer than one (1 s) second), some changes in the photopigments have taken place. Transient adaptation is usually insignificant in interiors, but can be a problem in brightly lighted interiors or exteriors where photopigment bleaching has taken place. The reduced visibility after entering a dark movie theater from the outside on a sunny day is an illustration of this latter effect.

Studies suggest that the primary photoreceptor system for melatonin suppression is distinct from the rod and cone photoreceptors for vision. This action spectrum suggests that there is a novel retinaldehyde photopigment that mediates human circadian photoreception.

SUMMARY

The L.E.D. (Light Emitting Diode) lighting fixture of the present invention has been developed as an alternative light source, capable of replacing typical fluorescent and incandescent fixtures. L.E.D.'s inherently emit either a direct highly concentrated beam spread or a diffuse light with extremely low lumens. The L.E.D. array is configured so that the light fixture emits a direct wide beam spread similar to the output of existing fluorescent and incandescent fixtures.

The L.E.D. lighting fixture can also be part of an emergency lighting system that can withstand extreme stresses, be reliable, and have a long life. It has been demonstrated that it is critical to an emergency lighting system to include the use of L.E.D.'s made with a scotopically rich primary color. Increasing the eye's ability to respond to low levels of light could be critical to a person's ability to react in an emergency situation. Also, the primary scotopic color of L.E.D.'s in this preferred system prepares the eye to respond and adapt quickly to changes in footcandles of light when the emergency lights come on.

L.E.D.'s typically have a lower lumen per watt output than fluorescent or incandescent lamps. Using L.E.D.'s with a higher scotopic output increases perceived light, visual acuity and response of the eye under typically low lumen output L.E.D.'s The designs of the present application address a number of problems including: mercury on nuclear vessels, breakage of normal light filaments during explosions or shock, the presence of ultraviolet light that degrades plastics over time, maintenance issues, interrupted light source with unreliable battery back-up, and high energy consumption, all of which are above and beyond normal fluorescent lighting used in Navy Subs and surface ships and any application where normal lighting and/or combined with emergency lighting highly resistant to explosion or shock is needed. Another problem addressed with this design is multiple shadows which are more pronounced with multiple L.E.D.'s and stronger lumen output L.E.D.'s. A novel shadow reduction lens with sub-lens helps reduce the shadowing problem and also helps keep up the lumen output of the fixture.

The use of scotopic/photopic blends and ratios help maximize eye to lumen response and photochemical and transient adaptation to darkness in emergency situations. The scotopic range of light can be adjusted to reduce melatonin levels depending on desired effects of performance of occupants of an environment. For example the $3^{rd}$ shift in a motor room or industrial application where a higher ratio, for example 50% blue light L.E.D.'s between 420–490 nm and 50% white light L.E.D.'s, could be increased or adjusted to lower melatonin levels and/or then the light ratio could be put back to any ratio of white light L.E.D.'s, therefore keeping $3^{rd}$ shift workers awake longer, depending on building design features including ceiling height and reflectivity of surfaces.

The L.E.D. lighting fixture configures arrays of L.E.D.'s so that light is spread out evenly and more closely matches the footcandle output and footcandle spread for a full 180 degrees or beam spread as required for each application.

The L.E.D. lighting fixture addresses a problem with temporary lighting used for example in construction or in mines where light fixtures are strung up in an area and not securely fastened and fixtures have been known to fall. There have been a number of instances of fatal shock that have occurred with high voltage lighting. The new L.E.D. lighting fixture 10 can be run on either high or low voltage therefore reducing or eliminating shock hazard. Also, the internal metal framing structure, which holds the L.E.D.'s, has special anodized coatings to make them non-conductive further insulating people from shock hazard.

BRIEF DESCRIPTION OF THE DRAWINGS

FIG. 3 is a perspective view illustrating the light emitting diode lighting fixture, constructed in accordance with the present invention, having a single tee mounting bar with multiple angled emitter plates;

FIG. 4 is a schematic view illustrating light distribution for the light emitting diode fixture of FIG. 3;

FIG. 5 is a perspective view illustrating the light emitting diode lighting fixture, constructed in accordance with the present invention, having a mounting bar and a multiple angled emitter plate assembly;

DETAILED DESCRIPTION OF THE PREFERRED EMBODIMENTS

Figure 1:
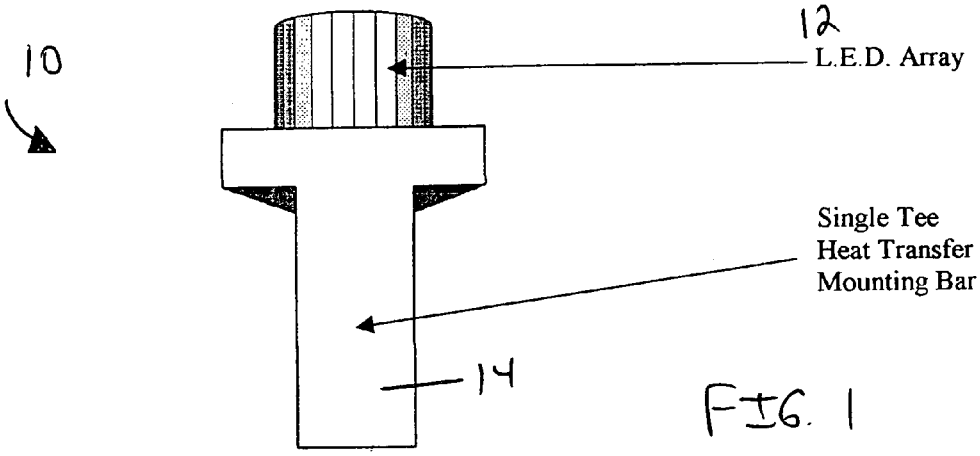
FIG. 1 is a perspective view illustrating a light emitting diode lighting fixture, constructed in accordance with the present invention, with a single tee mounting bar.

As illustrated in FIGS. 1–24, the present invention is an L.E.D. (Light Emitting Diode) lighting fixture, indicated generally at 10, for use as an alternative light source capable of replacing typical fluorescent and incandescent fixtures. L.E.D.'s inherently emit either a direct highly concentrated beam spread or a diffuse light with extremely low lumens. The L.E.D. array lighting fixture 10 of the present invention is configured so that the lighting fixture 10 emits a dispersed wide beam spread similar to the output of existing fluorescent and incandescent fixtures.

The L.E.D. lighting fixture 10 of the present invention configures arrays of L.E.D.'s 12 for spreading light evenly and more closely matching the footcandle output and footcandle spread for a full 180-degrees or a modified beam spread as required for each application. The L.E.D. lighting fixture 10 of the present invention can be used as temporary or permanent lighting.

The use of scotopic/photopic blends and ratios maximize eye to lumen response and photochemical and transient adaptation to darkness in emergency situations. The scotopic range of light can be adjusted to reduce melatonin levels depending on desired effects of performance of occupants of an environment. For example, the 3$^{rd}$ shift in a motor room or industrial application where a higher ratio, for example fifty (50%) percent blue between 420–490 nm and fifty (50%) percent white, could be increased to lower melatonin levels therefore keeping 3$^{rd}$ shift workers awake longer, depending on building design features including ceiling height and reflectivity of surfaces.

As light levels decrease, the human eye responds more to blue light and less to yellow/red light. As light levels decrease, the human eye also loses transmission of blue light. With age, the eye also loses transmission of blue light and therefore benefits from more blue-light energy. The intent of a scotopic rich L.E.D. lighting fixture 10 of the present invention is to address both of these conditions and enhance human vision. In addition, the scotopic/photopic combination is balanced to produce a good Color Rendering Index (CRI) for photopic vision. Preferably, this number is eighty-five (85) or greater to allow for very good color differentiation; however, a blend containing lower CRI will still provide excellent visualization for tasks such as reading, which require no color sensitivity.

The L.E.D. lighting fixture 10 of the present invention is also developed to be part of an emergency lighting system. The inventors of the present application believe that it is critical to an emergency lighting system to include the use of L.E.D.'s 12 made with a scotopically rich (between 5,000° K. and 10,000° K.) primary color. Also, L.E.D.'s 12 that are 450 nm blue color can be intermixed with L.E.D.'s 12 that are of a white 4100° K. color temperature to also give a desired scotopic/photopic blend. Further, the blend of intermixed blue 450 nm L.E.D.'s 12 can be increased to affect a decrease in melatonin production. The eye's ability to respond to low levels of light could be critical to a person's ability to react in an emergency situation. Also, the primary scotopic color of L.E.D.'s 12 prepares the eye to respond as discussed in Background of the Invention and adapt quickly to changes in footcandles of light when the emergency lights are illuminated.

L.E.D.'s typically have a lower lumen per watt output than fluorescent or incandescent lamps. Using L.E.D.'s 12 with a higher scotopic output increases perceived light, visual acuity, and response of the eye.

The benefit of the 420–490 nm blue light is melatonin regulation, but the blue light alone is a light source that may be difficult to work and/or read under. While using this blue light source, if a person looks away, for example out a window or into another room which is not illuminated by the same blue light source, the surroundings may appear extremely yellow and depth perception may be distorted; this is commonly called visual chaos. Also, in some cases a person's equilibrium may be disturbed. This is because the blue light saturates the rods of the eye and the person's color perception mechanism did not have time to adapt to the consequences of the color spectra of the different light sources, in this case the blue light source and the daylight outside the window. The blue light may be balanced by adding white light, thereby mitigating the negative effects of the blue light while still experiencing the benefits of the blue light melatonin regulation. The L.E.D. lighting fixture 10 array of the present invention can be configured with various amounts of each blue and white L.E.D.'s 12, balanced appropriately for each specific application. A balanced blue spectrum therapy lighting fixture 10 could contain an array of L.E.D.'s 12, some blue and some white. The various amounts of each blue and white would be balanced appropriately for each specific application. The range can go from approximately ninety (90%) percent 420–490 nm blue and approximately ten (10%) percent white, to only approximately ten (10%) percent blue and approximately ninety (90%) percent white depending on the application. The preferred ratio of the present invention is approximately fifty (50%) percent blue light and approximately fifty (50%) percent white light. The L.E.D. lighting fixture 10 of the present invention can be adjustable with a switching mechanism, either electronic or mechanical, or even activated by radio frequency control so that a person can adjust the blue and white scotopic/photopic light levels, thereby affecting their, visual acuity, lumen eye response, desired sleep control and melatonin levels as desired.

Concerning melatonin, Applicant herein hereby incorporates by reference U.S. Pat. application Ser. No. 10/688,009, filed Oct. 17, 2003.

A light prescription for desired performance for workers or occupants can be implemented with the lighting fixture 10 of the present invention. Workplace Dynamic Prescription (WDP) means that levels can be changed as needed for desired effects. The L.E.D. lighting fixture 10 of the present invention addresses the problem with temporary lighting used for example in construction where light fixtures are strung up in an area and not securely fastened and they have been known to fall. There have been a number of instances of fatal shock that have occurred. The L.E.D. lighting fixture 10 of the present invention can be operated on either high or low voltage therefore reducing or eliminating shock hazard. Also, the internal metal framing structure, which holds the L.E.D.'s 12, has special coatings to make them non-conductive further insulating people from shock hazard.

The preferred L.E.D. 12 blend of the L.E.D. lighting fixture 10 is composed of combined commercially available L.E.D.'s 12 to give light primarily in the 400–620 nm range. The resulting emitted light spectrum favoring the human eye scotopic-response curve, peaks at approximately 500 nm, but is not necessary for the present invention.

As light levels decrease, the human eye responds more to bluer light (scotopic) and less to yellow/red light (photopic). As light levels decrease, the human eye also loses transmission of blue light. With age, the eye also loses transmission of blue light and therefore benefits from more blue-light energy. The intent of a scotopic L.E.D. blend of the present invention is to address both of these conditions with an L.E.D. that enhances human vision. In addition, the L.E.D. 12 combination is balanced to produce a good Color Rendering Index (CRI) for photopic vision. Preferably, this number is 85 or greater to allow for very good color differentiation; however, a blend containing lower CRI will still provide excellent visualization for tasks such as reading, which require little color sensitivity.

The L.E.D. lighting fixture 10 of the present invention corrects negative perception of scotopic light. Scotopic blue lamps can produce certain problems: they visually distort skin tones and they may cause headaches and nausea. The L.E.D. 12 blends of the present application can have red L.E.D.'s added to correct the color to avoid the common negative response by the public to the overly blue pasty look of the human skin under typical scotopic light. With the added red tone the L.E.D. 12 blend can produce light that is scotopically and photopically balanced between fifty (50) to ninety-five (95) CRI, thus eliminating the problems associated with blue scotopic lamps.

The Kelvin correlated color temperature in the scotopic spectrum can range between 5,000° K. and 10,000° K. The inventors of the present application have found the correlated color temperature 7,500° K. super daylight range with a 2.50 scotopic to photopic ratio to be nominally rich in scotopic eye response and a complimentary match for the blend. This can be adjusted depending on future research. Note: it is critical that the highest scotopic to photopic ratio be obtained for maximum visual acuity and emergency response and a light prescription for desired performance or workers or occupants, or Workplace Dynamic Prescription (WDP) which means that levels can be changed as needed for desired effects; and a Kelvin temperature between 3,000° K. and 5,000° K. still can be used for this invention and would not affect shadowing phenomenon, light spread, pulsing heat reduction, and heat sinking and/or reduced voltage heat regulation of L.E.D. 12.

Conventional L.E.D.'s inherently do not emit ultraviolet light. The addition of a UV component to the L.E.D. lighting fixture 10 creates a full spectrum natural light with UVA/B balance can be added or adjusted for different applications without changing the effectiveness of this scotopic blend.

The scotopic L.E.D. 12 can be adjusted to be particularly rich in the scotopic spectrum (approximately between 420–550 nm) of light. At approximately 420 nm the melatonin reaction starts and at approximately 550 nm the melatonin reaction ends. The benefit of these wavelengths of light (enhanced blue energy) is that it can reduce the output of melatonin in the human body. Melatonin regulates the circadian cycle of sleep. The scotopic blue light spectrum of the present invention for melatonin reduction can be adjusted as future research dictates. As of now, the range 440–480 nm shows the greatest results. The scotopic L.E.D.'s 12 of the present invention are intended for installation in work environments such as in a submarine or an engine room of a boat where there is a lack of sunlight and where it is critical that the worker remain awake and alert. Therefore, the worker will have lower melatonin levels and a better chance to remain awake and alert, and also their eyes would be scotopically stimulated and ready to react to emergency low light situations. The scotopic L.E.D. 12 blend of the present invention could be used as light therapy for S.A.D. (Seasonal Affective Disorder) and be therapeutic in a low light environment such as a submarine along with its emergency light qualities.

Figure 19:
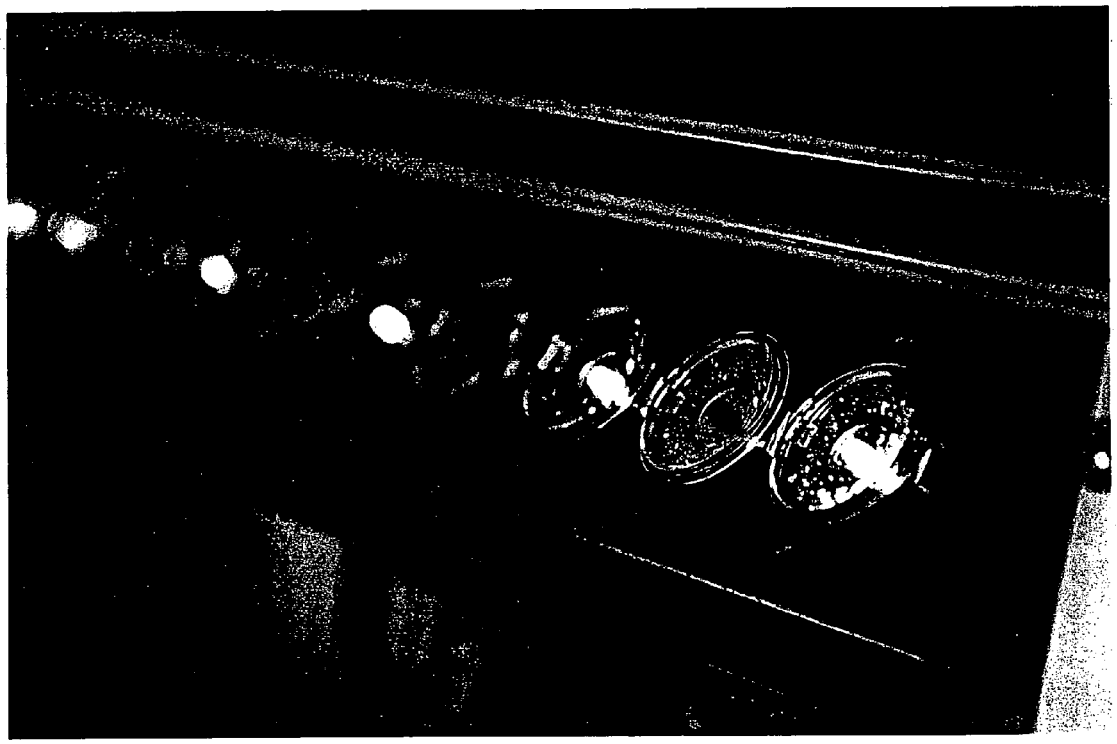
FIG. 19 is a perspective view illustrating the light emitting diode lighting fixture, constructed in accordance with the present invention, with blue and white light emitting diode array.
Figure 20:
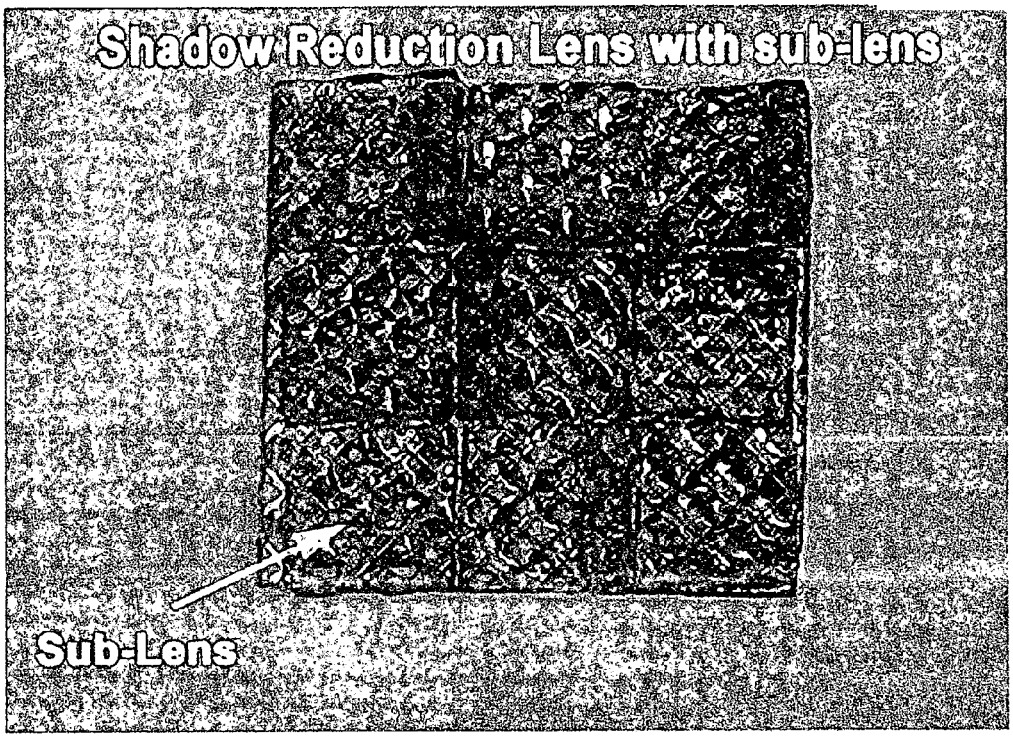
FIG. 20 is a top view illustrating a multiple shadow reduction lens of the light emitting diode lighting fixture, constructed in accordance with the present invention.
Figure 21:
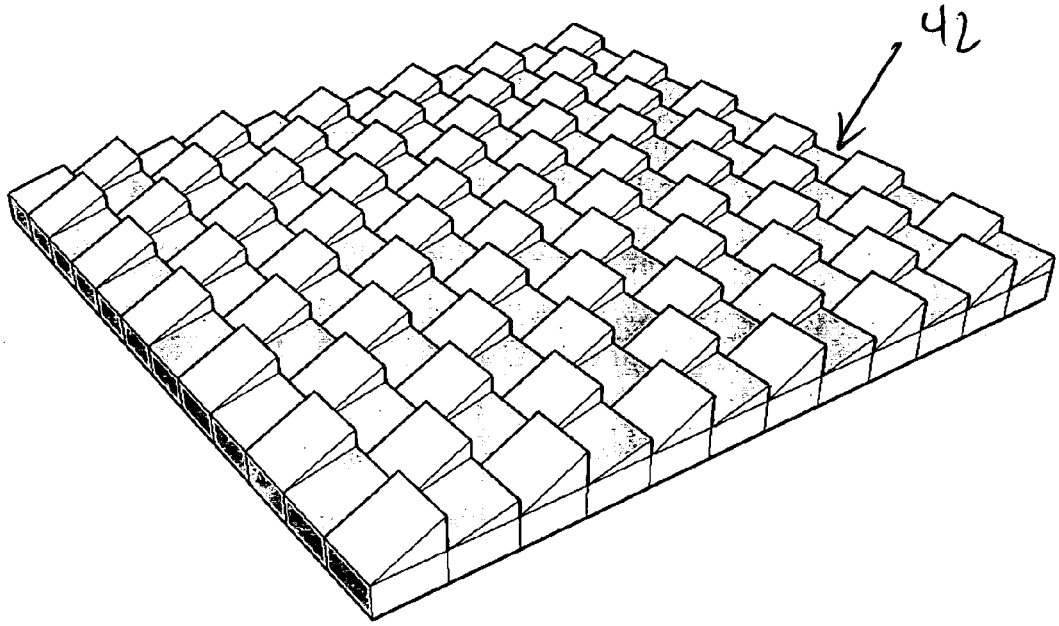
FIG. 21 is a perspective view illustrating the multiple shadow reduction lens of the light emitting diode lighting fixture, constructed in accordance with the present invention.
Figure 22:
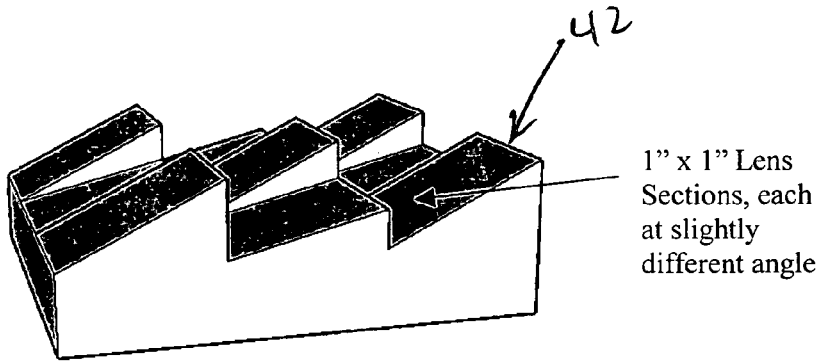
FIG. 22 is a perspective view illustrating a portion of the multiple shadow reduction lens of the light emitting diode lighting fixture, constructed in accordance with the present invention.
Figure 23:
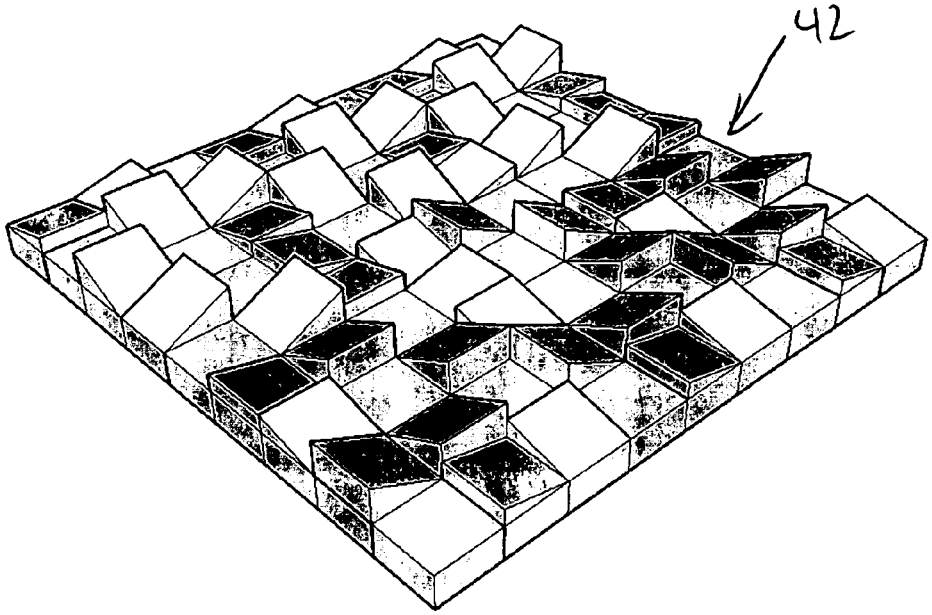
FIG. 23 is a perspective view illustrating another embodiment of the multiple shadow reduction lens of the light emitting diode lighting fixture, constructed in accordance with the present invention.
Figure 24:
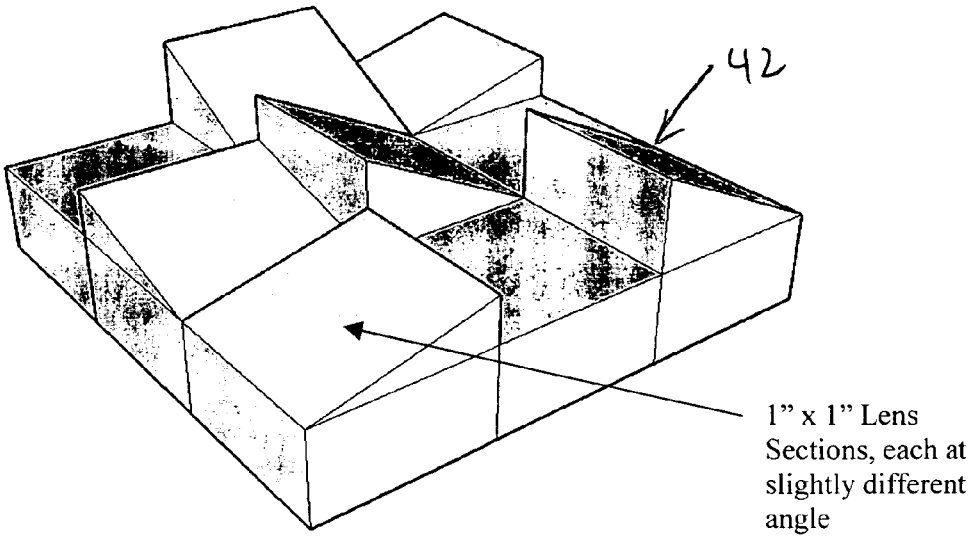
FIG. 24 is a perspective view illustrating a portion of the multiple shadow reduction lens of FIG. 23 of the light emitting diode lighting fixture, constructed in accordance with the present invention.

As illustrated in FIG. 19, the L.E.D. lighting fixture 10 of the present invention can be remotely controlled so that only the blue light ranging close to 420–490 nm would come on. This could be used in high security buildings, secured or hardened areas, and/or boats in case of terrorist attacks. The 420–490 nm blue light would make the occupants feel sick and experience visual chaos, thereby reducing their ability to function at their best performance. Security guards could be outfitted with filtering lenses on helmets that would allow them to move through the area unaffected by the blue light. Another mode of operation of blue light eye saturation would be to turn on all blue light then pulse to white or back and forth between blue and white to cause extreme visual chaos.

Human response time is critical in an emergency. The particular scotopic L.E.D. 12 blends of the present invention produce light that enhances the eye's ability to adapt to varying lower light levels, therefore photochemical adaptation and transient adaptation response times are quicker. Because the time required to accomplish photochemical reactions is finite, changes in the sensitivity lag behind the stimulus changes. The cones of the eye adapt much more rapidly than do the rods of the eye; even after exposure to high levels of brightness, the cones will regain nearly complete sensitivity in approximately ten (10) minutes–twelve (12) minutes, while the rods will require approximately sixty (60) minutes (or longer) to fully dark-adapt. The scotopic L.E.D. 12 blends of the present application, in fact, places the eye in a state of emergency readiness because the eye is already operating under higher scotopic light levels therefore engaging the stimulation of the rod receptors in the eye. The amount of scotopic enhancement of these blends that can be adjusted determines the amount of increased or decreased dilation of the pupil and engagement of the eye's rods. The amount of dilation and rod receptor stimulation under this scotopic L.E.D. 12 blend prepares the eye to respond to lower light levels. Therefore the eye's photochemical adaptation and transient adaptation response times are quicker. As a result, human response time is critically reduced in an emergency. Scotopic illuminant predicts pupil size and has been demonstrated in several studies.

The L.E.D. lighting fixture 10 of the present invention containing these scotopic rich L.E.D. 12 blends needs one-third (⅓) the power to achieve the same visual acuity as photopic lighting. Less L.E.D.'s use less power, one-third (⅓) less. These L.E.D. 12 blends are critical as to application of use of energy in a critical situation such as a submarine or military installation where the amount of bulbs and wattage can be reduced with the use of these scotopic L.E.D. 12 blends, therefore electrical power can be conserved. Scotopic light usage and reduction of energy used is well documented. The eye has to work less hard to achieve the same visual acuity. In a submarine, an engine room of a boat, or a building it is critical that power consumption. Therefore, the use of scotopic rich light is of great importance. Because less L.E.D.'s have to be used and less wattage is used the battery back up will be able to operate longer.

One of the side effects of fluorescent or general photopic lighting is glare on monitors such as computers or other instrumentation. The L.E.D. lighting fixture 10 of the present invention reduces glare, increases visual acuity, and increases black and white contrast. This scotopic blend has a lower lumen output therefore reducing glare on the monitor screen. Approximately one-third to one-half less lumens as in regular fluorescent lighting are needed for the same visual acuity. Typically L.E.D.'s have a lower lumen output than fluorescent lamps. The function of this scotopic blend is to increase the amount of perceived light entering the human eye.

Low light operation occurs in places such as pilot rooms on boats or airplanes. One of the side effects of nighttime navigation is the problem of reading under light to see charts or instrumentation and then having to look out into darkness. This is another example of photochemical adaptation and transient adaptation response times. With these scotopic L.E.D.'s 12, the pilot could read or perform tasks and look out into darkness with minimal effect on his or her visual adaptation. The scotopic L.E.D.'s 12 could also benefit pilots by regulating melatonin stimulus. Falling asleep is a well-documented problem for nighttime navigators. In the event of a catastrophic power failure, the emergency back-up L.E.D.'s could illuminate to allow the pilot to continue to read charts or perform simple tasks. This is an example application for a light prescription for desired performance of workers or occupants, or Workplace Dynamic Prescription (WDP) means that levels can be programmed as needed for desired effects could be used.

The L.E.D. lighting fixture 10 of the present invention could be retrofitted into a wide variety of fluorescent and incandescent fixtures or could be built as an entirely new fixture. The L.E.D.'s 12 could fit into existing fluorescent and incandescent battery backup emergency lighting fixtures extending their time of emergency luminance because the L.E.D.'s 12 can use less voltage, amperage, and watts. The L.E.D.'s 12 could also be put into any location where unpredictable power disruption happens frequently.

Figure 2:
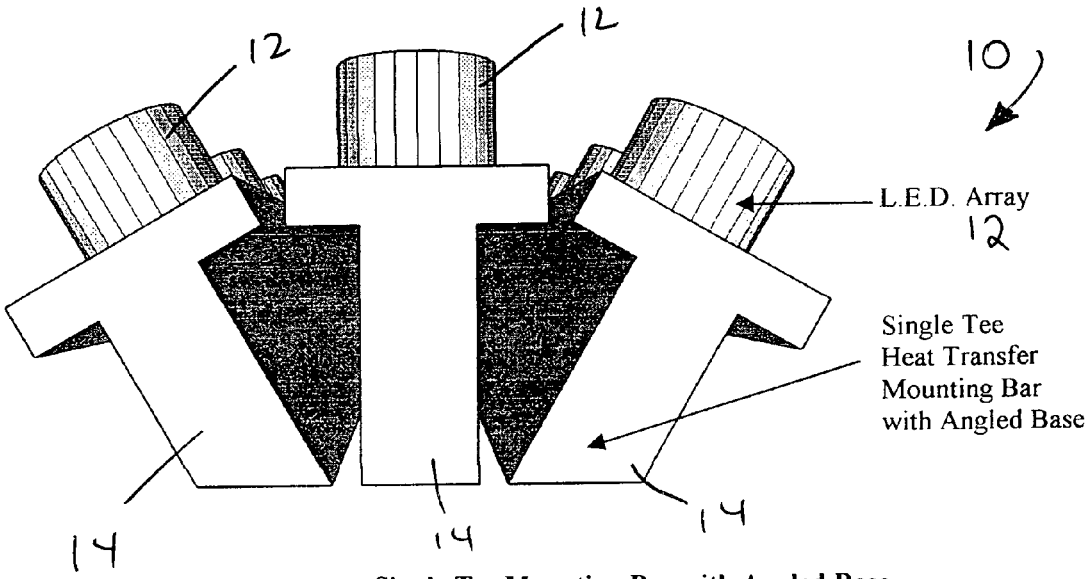
FIG. 2 is a perspective view illustrating the light emitting diode lighting fixture, constructed in accordance with the present invention, having a single tee mounting bar with an angled base.

As illustrated in FIGS. 1 and 2, the L.E.D. arrays 12 can be mounted on a heat transfer mounting bar 14. The heat transfer mounting bar 14 can be cut at various angles to give different beam spreads as required for different applications. Add-on or extruded heat sink fins 16 can also be used in these designs.

As illustrated in FIGS. 3 and 4, a single tee heat transfer mounting bar 14 with multiple angled emitter plates 18 allows for L.E.D.'s 12 at multiple angles while having only one connection point to the lighting fixture body. The heat sink fins 16 can be either extruded or add-on. This design can also work without heat sink fins.

The lighting fixture 10 power sources can be AC (Alternating Current) or DC (Direct Current). Low DC voltage reduces the risk of electrocution on the job site or in the event of an explosion or damaged lighting fixture. L.E.D. drivers for this implementation of the L.E.D. lighting fixture 10 can incorporate features such as current pulsing, L.E.D. current regulation, reducing heat and extending life of the L.E.D. 12, programmable emergency path indicators, and light prescription features for desired effects.

Mercury is an especially hazardous material on nuclear submarines and boats, and the L.E.D. lighting fixture 10 of the present invention would be most important in these use areas since no mercury is required.

The L.E.D. lighting fixture 10 used as temporary lighting will be equipped with quick disconnects for ease of use and will also feature plug and play technology for ease of assembly and repair.

An emergency battery backup added to the L.E.D. lighting fixture 10 could be a small or large battery pack with or without chargers and could provide between one (1%) percent to one hundred (100%) percent of the normal operating lighting level for between one (1) minute to ninety (90) minutes, or as needed for specific areas, or specific building codes and/or military specifications after the power source is cut. Sensors and relays will activate the fixture when the power is cut.

Fire sensors could be added to activate the fixture 10 when smoke is detected. Smoke or programmed responses activate the L.E.D.'s 12 for specific conditions. One such condition is to pulse every other L.E.D. 12 or in an arrow design array to indicate the intended direction to follow for egress from an area.

Since the L.E.D. linear-type fighting fixture 10 contains no delicate filaments typical of fluorescent and incandescent lights, the unit will be able to withstand hard shocks and abuse therefore making it ideal for temporary movable lighting requirements and harsh shock hazard environments.

The L.E.D.'s 12 can be tinted and/or arranged in percentages so that the overall light is in the blue/scotopic range of 5,000° K. to 10,000° K. and the preferred range of 420–490 nm to lessen and/or regulate the symptoms of S.A.D. (Seasonal Affective Disorder). Turning on ten (10%) percent to ninety (90%) percent of the L.E.D.'s 12 of 420–490 nm blue can also be arranged to blend in a scotopic blue response as needed as discussed in Background of the Invention.

The L.E.D.'s 12 can be tinted and/or arranged in percentages so that the overall light is in the blue/scotopic range of color to improve the eye response. That way the rods of the eye are more sensitive to the scotopic light and less lumens can be used to get the same output as photopic light therefore maximizing the lower output of the L.E.D.'s 12 as discussed in Background of the Invention.

Special anodized coatings can be applied to all metal pieces used for military or industrial or any appropriate applications. The anodized coatings are non-conductive to protect against and further reduce shock hazards. The anodized coatings also protect against saltwater corrosion and meet a number of military specifications including the Tabor Abrasion Test. The anodized, color black is preferred because it further reduces heat dissipation by approximately five (5%) percent.

As illustrated in FIG. 5, the L.E.D.'s 12 must remain cool or else their life expectancy will be reduced. The mass of the L.E.D. heat transfer mounting bar 14 and multiple angled emitter plate 18 assembly must conduct heat to one or many avenues for heat dissipation. One avenue is the extruded and/or the add-on heat sink fins 16 applied to the emitter plates 18. A fan 20 would maximize heat transfer. This implementation would lessen the need for the thicker heat transfer mounting bar 14 and lighten the weight of the assembly.

The heat transfer mounting bars 14 connect the emitter plates 16 to the lighting fixture body mass and conducts heat from the L.E.D.'s 12 to the outside of the lighting fixture 10. This connection conducts heat and it can be adjusted for size and flow of heat transfer to the fixture body 24 of the lighting fixture 10, which is considered to be a part of the heat sink. Heat must be transferred to the lighting fixture body 24 to lower inside heat temperatures. In extreme cases of high temperatures heat sink fins 16 can be applied to the outside of the lighting fixture body 24. Also an exterior fan can be added to the exterior heat sinks to further cool the fixture. Depending on how many L.E.D.'s 12 are used determines how much heat is created in the unit and this determines the thickness of this heat transfer channel.

Figure 6:
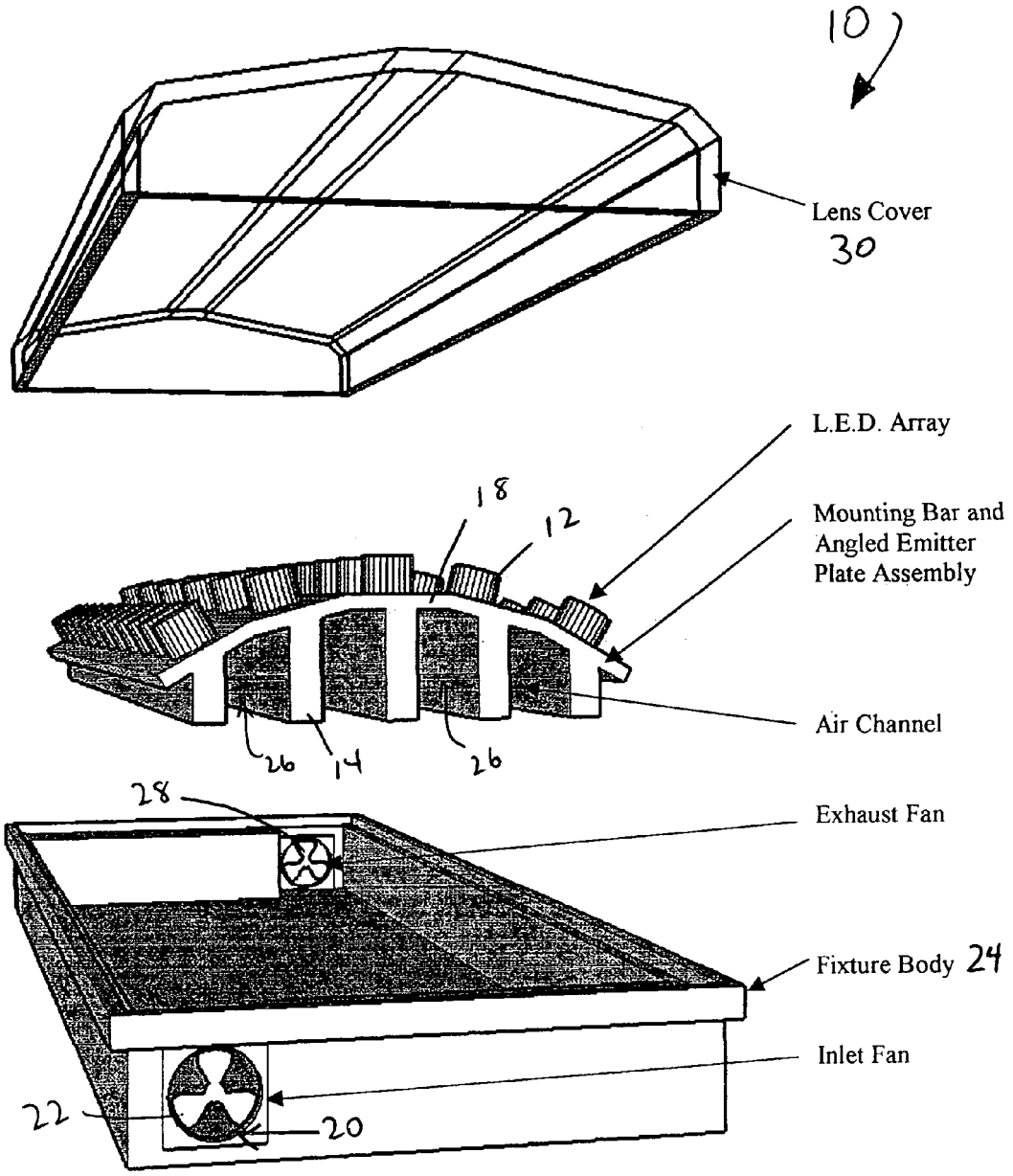
FIG. 6 is an exploded view illustrating the light emitting diode lighting fixture, constructed in accordance with the present invention, having active cooling and heat reduction.

As illustrated in FIG. 6, incorporating an interior fan 22 in the lighting fixture 10 moves air through the interior of the lighting fixture 10 or around the exterior of the lighting fixture 10 to help reduce temperature of L.E.D.'s 12. In an enclosed or sealed fixture 10, there is no air movement in the lighting fixture 10. Staggered air channels 26 prevent exhaust air from entering the inlet of adjacent fixtures. Blowing air into the lighting fixture 10 is more efficient than pulling air through fixture. A second implementation utilizes two fans 22, 28 of which one is pushing and the second is pulling for maximum cooling and minimum weight of the lighting fixture.

Duty-cycle or current pulsing the L.E.D.'s 12 keep the L.E.D.'s 12 cooler and lasting longer. Electronic current pulsing of the L.E.D. 12 at a pulse rate over, but not limited to sixty (60) cycles per second which is beyond the rate of human eye response or detection. Pulsing with a high-current, low duty cycle L.E.D. driver increases L.E.D. brightness and minimizes heat buildup.

When current flows through the L.E.D.'s 12, an operating window exists where current/heat balance is below the manufacturer's maximum specification. The L.E.D.'s 12 performance window depends on the lumens/foot-candles and/or color output needed for the specific application. Reducing the current shifts color output. This reduction of current substantially increases the life expectancy of the L.E.D 12. This current reduction process there is an optimum point where the L.E.D. 12 emits acceptable light color and acceptable foot-candle output with lower heat temperatures. This balance of current, heat, light color, and light output can vary up to fifty (50%) of the manufacturer's recommended current rating. Furthermore the combination of pulsing and current reduction maximizes heat reduction, color shifting and lumen output. A light prescription for desired performance of workers or occupants, or Workplace Dynamic Prescription (WDP) means that levels can be changed as needed for desired effects. The combination of all these parameters is critical for implementing a sealed lighting fixture that is portable or fixed installation.

Programming of the lighting fixture 10 for light prescription for desired performance or workers or occupants. A light prescription for desired performance of workers or occupants, or Workplace Dynamic Prescription (WDP) means that levels can be changed as needed for desired effects.

The light color of the lighting fixture 10 can be adjusted depending on the application. For example, in a pilot room of a submarine, red light is required to come on in battle conditions at certain times.

The angles of the emitter plates 18 can vary depending on which L.E.D. 12 type is used. There are two different types of L.E.D.'s 12 to use in the lighting fixtures 10 depending on the application: One type is side emitting and another type is forward emitting with or without directional lens. Side emitting L.E.D.'s 12 give lower foot-candle measurements at approximately five (5') feet. One advantage of side emitting L.E.D.'s 12 is a more uniform light beam spread that is uniform off to the sides at 180 degrees and reduces the banding of light pattern to give an overall uniform light from the lighting fixture 10. They also would have value for reflection off side-walls of an MR 16 or similar type reflector.

A prismatic lens cover 30 over the unit helps to diffuse the light evenly in all directions. The prismatic lens cover 30 will scatter the light to fill in dark spots between the individual L.E.D. 12 beam patterns. The forward directional L.E.D.'s 12 with lenses 30 tend to show up on a flat surface as bands of light. The prismatic lens 30 substantially blends the banded light patterns into a more uniform illuminated pattern.

Figure 7:
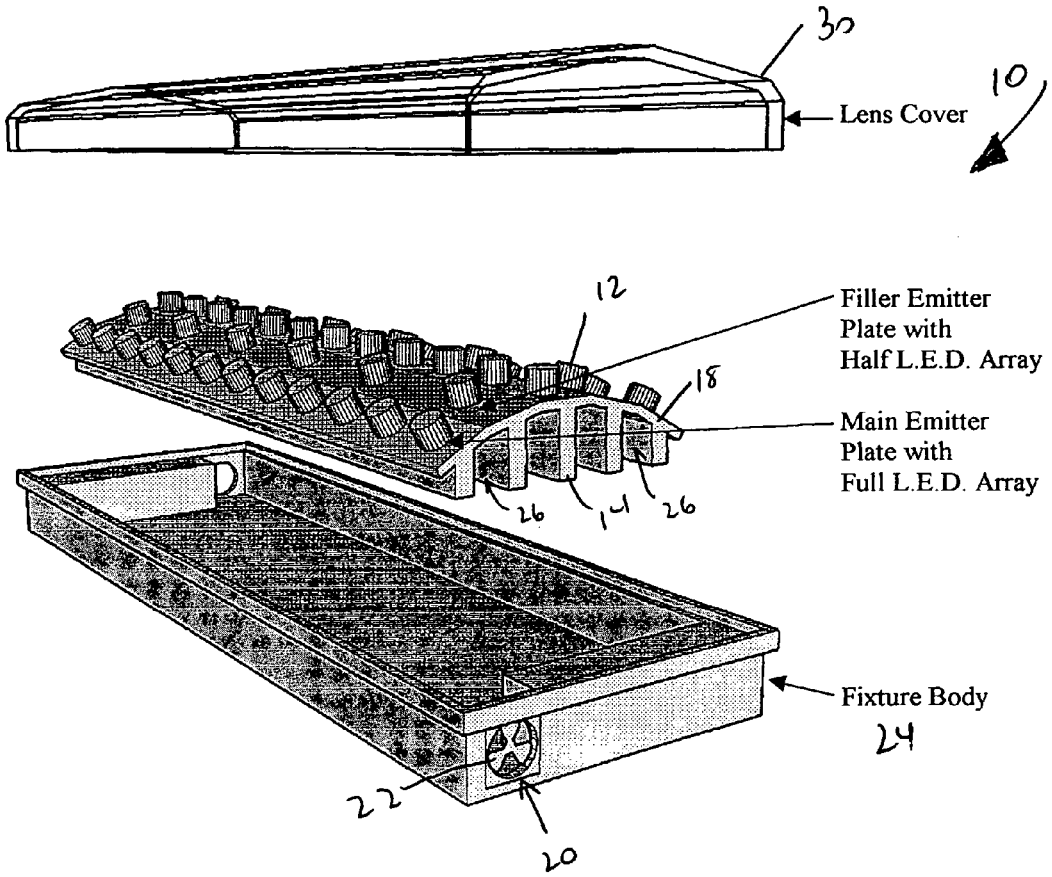
FIG. 7 is an exploded view illustrating the light emitting diode lighting fixture, constructed in accordance with the present invention, having filler emitter plates.
Figure 8:
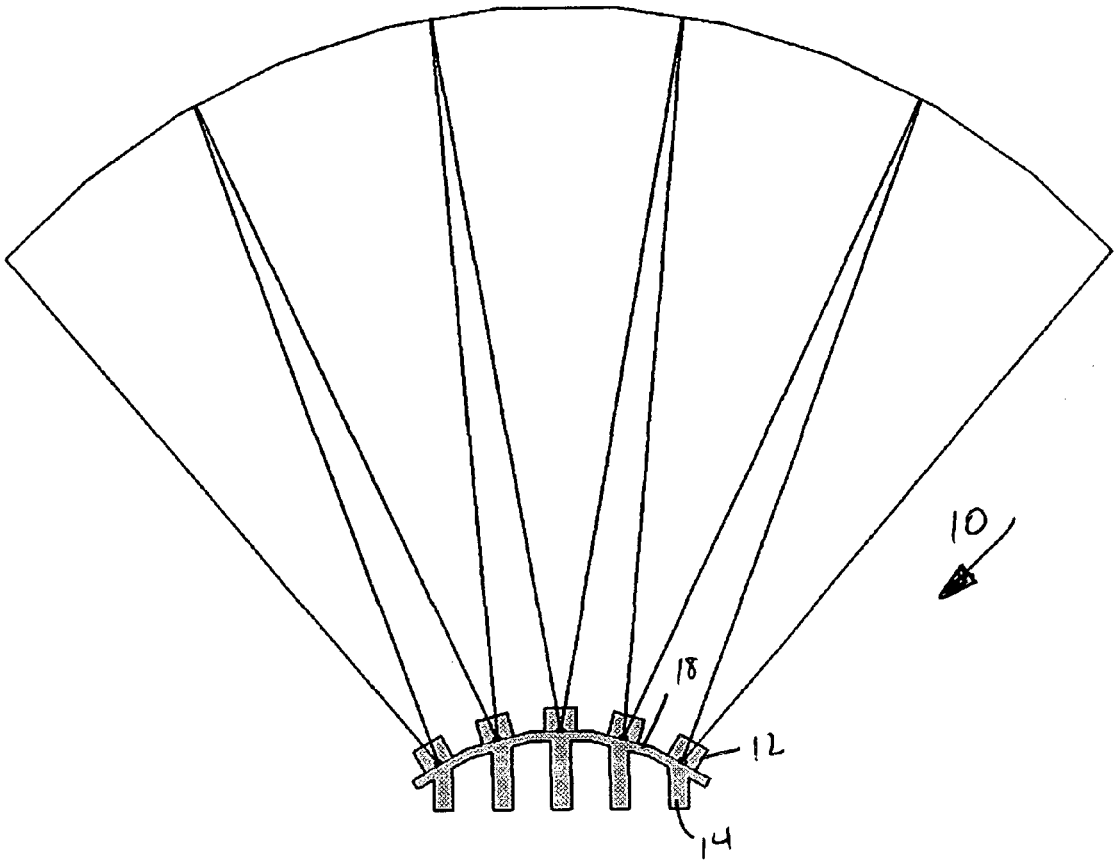
FIG. 8 is a schematic view illustrating the light distribution of the light emitting diode fixture of FIG. 7.

As illustrated in FIGS. 7 and 8, the number of L.E.D.'s 12 in the lighting fixture 10 can vary depending on how many foot-candles and light beam pattern that are required for the application. Dark areas between the main emitter plate L.E.D. 12 light beam projections typically cause noticeable banding of the light. Fill in of dark areas in beam patterns can be achieved with filler emitter plates 32 that have a reduced number of L.E.D.'s 12 and are positioned between the main emitter plates 18.

Figure 9:
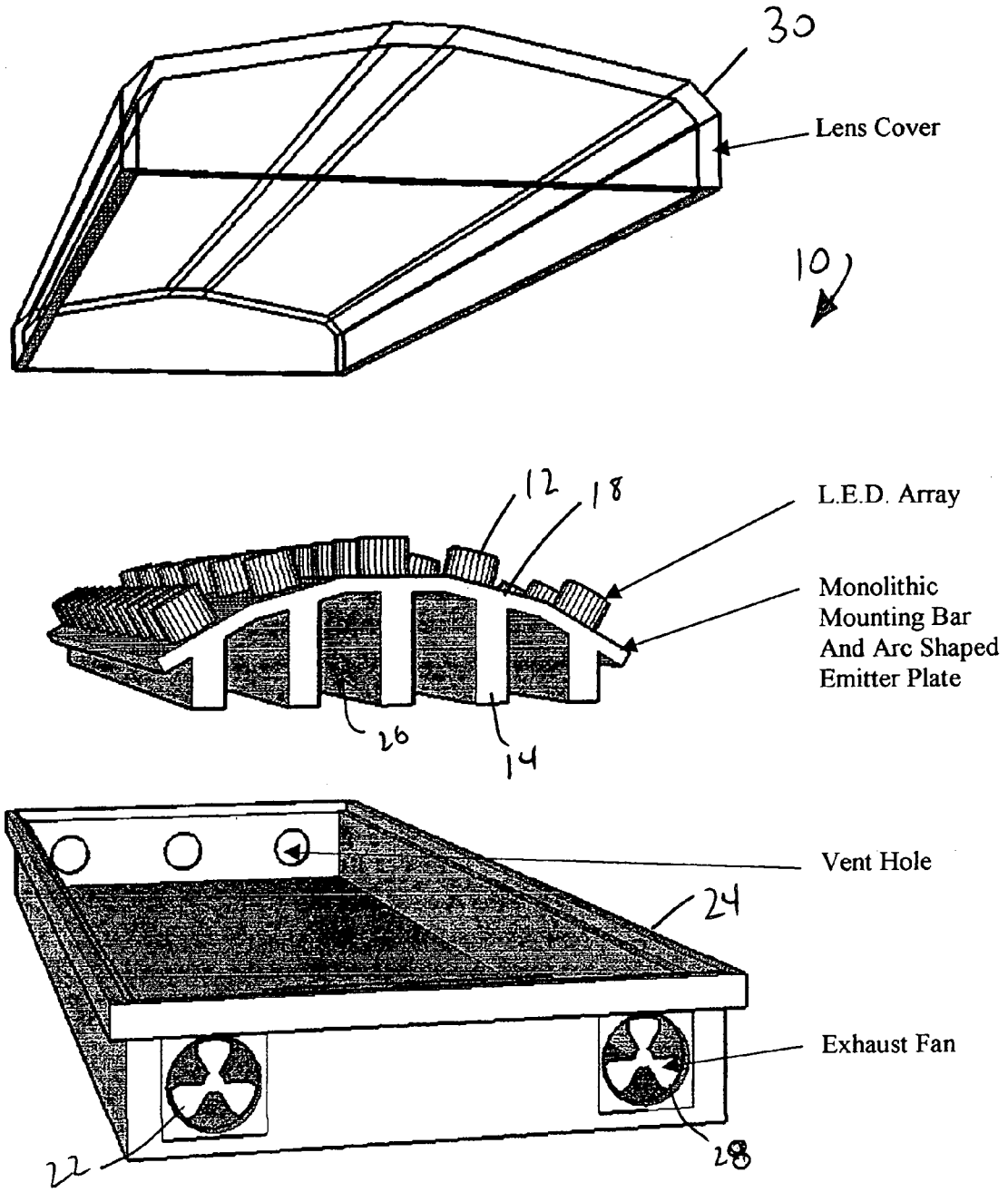
FIG. 9 is an exploded view illustrating the light emitting diode lighting fixture, constructed in accordance with the present invention, having a monolithic mounting bar and arc-shaped emitter plate.

As illustrated in FIGS. 8 and 9, the arc-shaped emitter plate 18 incorporates multiple emitter plate angles to make light distribution more even. The monolithic mounting bar 14 and arc-shaped emitter plate 18 has multiple heat transfer mounting bar bases 34 to reduce the temperature of L.E.D.'s 12. Heat-sink fins 16 and/or fans 20 can be added to this design. This implementation enables quick installation and faster repair.

Figure 10:
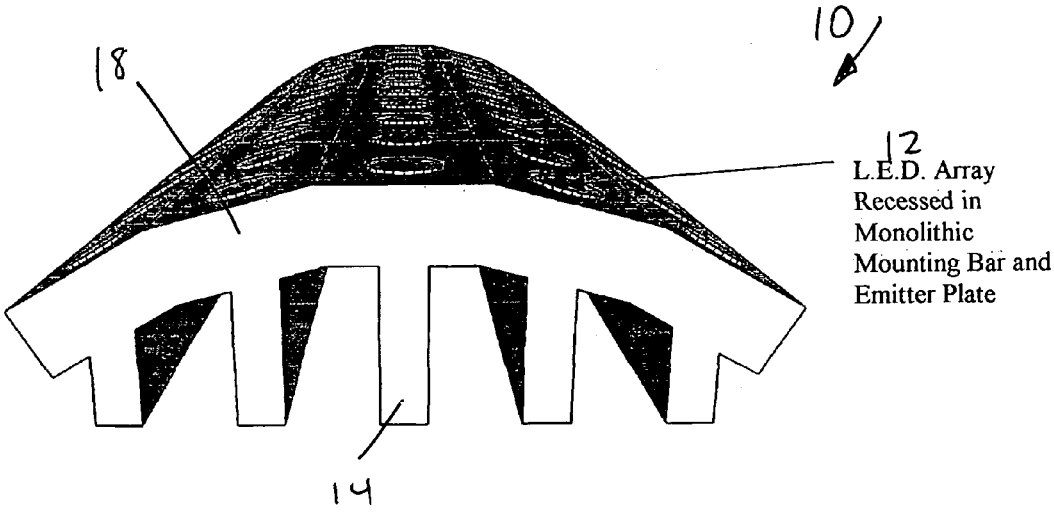
FIG. 10 is a perspective view illustrating the light emitting diode lighting fixture, constructed in accordance with the present invention, having a recessed light emitting diode array.

As illustrated in FIG. 10, L.E.D.'s 12, with or without lenses, recessed into the top of the emitter plate 18 offer a robust design, reduced weight, and localized heat transfer to the heat transfer mounting bar 14. Heat sink fins 16 could also be added to this design.

Figure 11:
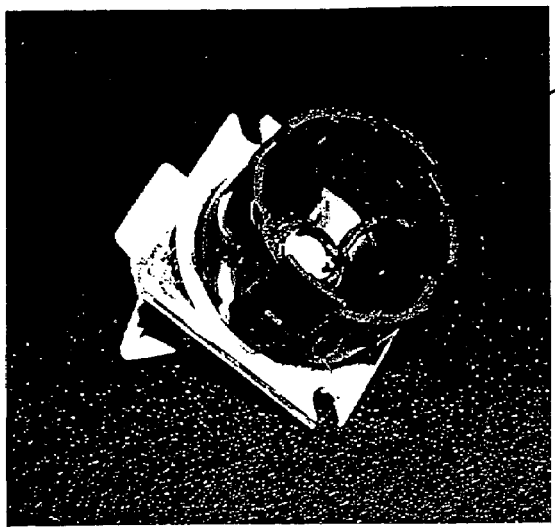
FIG. 11 is a perspective view illustrating an interior chrome lens cup of the light emitting diode lighting fixture, constructed in accordance with the present invention, for maximizing light output.

As illustrated in FIG. 11, an interior chrome plated smooth or faceted lens cup 36 has been shown to maximize light output.

Emergency after-glow paint with an after-glow strauntium/aluminate base can be used inside the lighting fixture 10 to enhance emergency back-up light.

A small number of L.E.D.'s 12 can be powered by capacitor (non-battery) back-up for extreme enhanced emergency backup.

Figure 12:
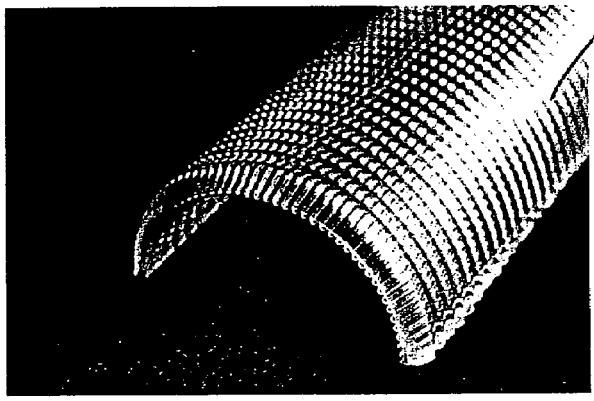
FIG. 12 is a perspective view illustrating a lens bar of the light emitting diode lighting fixture, constructed in accordance with the present invention, with vertical and horizontal element construction for reducing the shadowing phenomenon.

Multiple point light sources generate noticeable multiple shadows. Shadow reduction technology incorporated in to this invention makes fewer shadows. The following implementations demonstrate reduction of shadow effect:

As illustrated in FIG. 12, a lens bar design with vertical and horizontal element construction substantially reduces shadowing phenomenon.

Figure 13:
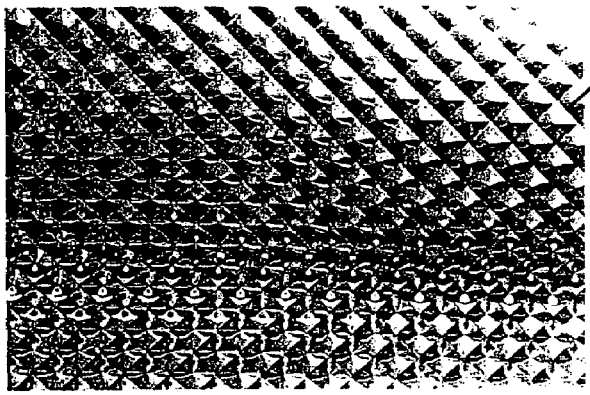
FIG. 13 is a perspective view illustrating a varying degree angle prismatic sub-lens of the light emitting diode lighting fixture, constructed in accordance with the present invention, for reducing the shadowing phenomenon.
Figure 14:
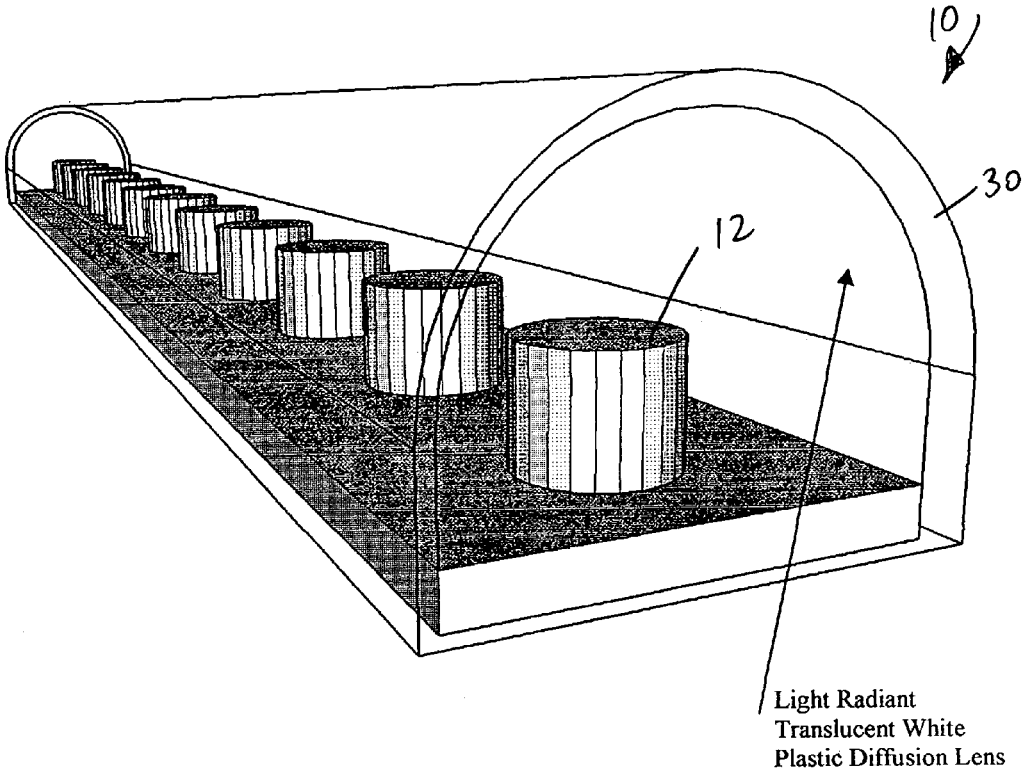
FIG. 14 is a perspective view illustrating the light emitting diode lighting fixture, constructed in accordance with the present invention, with a plastic diffusion lens.

As illustrated in FIG. 13, diffusion material configured in an arch, consisting of a light radiant translucent white plastic fashioned in an arch diffuses each individual L.E.D.'s 12 beam pattern in such a manner so as to minimize observable shadowing phenomenon. It has been further found that texturing the insides of the diffuser can further reduce shadowing phenomenon.

As illustrated in FIG. 13, a varying angle of a large patterned prismatic lens further reduces shadowing phenomenon.

A holographic optical element tailored to the light emission profiles from a specific L.E.D. 12 array to blend the multiple light sources into one congruent light source, reducing shadows. This diffraction grating process needs to be adjusted specifically for individual L.E.D. 12 lighting arrays.

Up-lighting of ceiling is possible by aiming the lighting fixture 10 upwards. This reduces shadowing effect of multiple L.E.D.'s 12.

L.E.D.'s 12 on a pre-wired plug and play board make installation and repair quick and easy and reduces labor to effect repairs.

The lighting fixture 10 length can be of any length for functionality or aesthetics.

Figure 15:
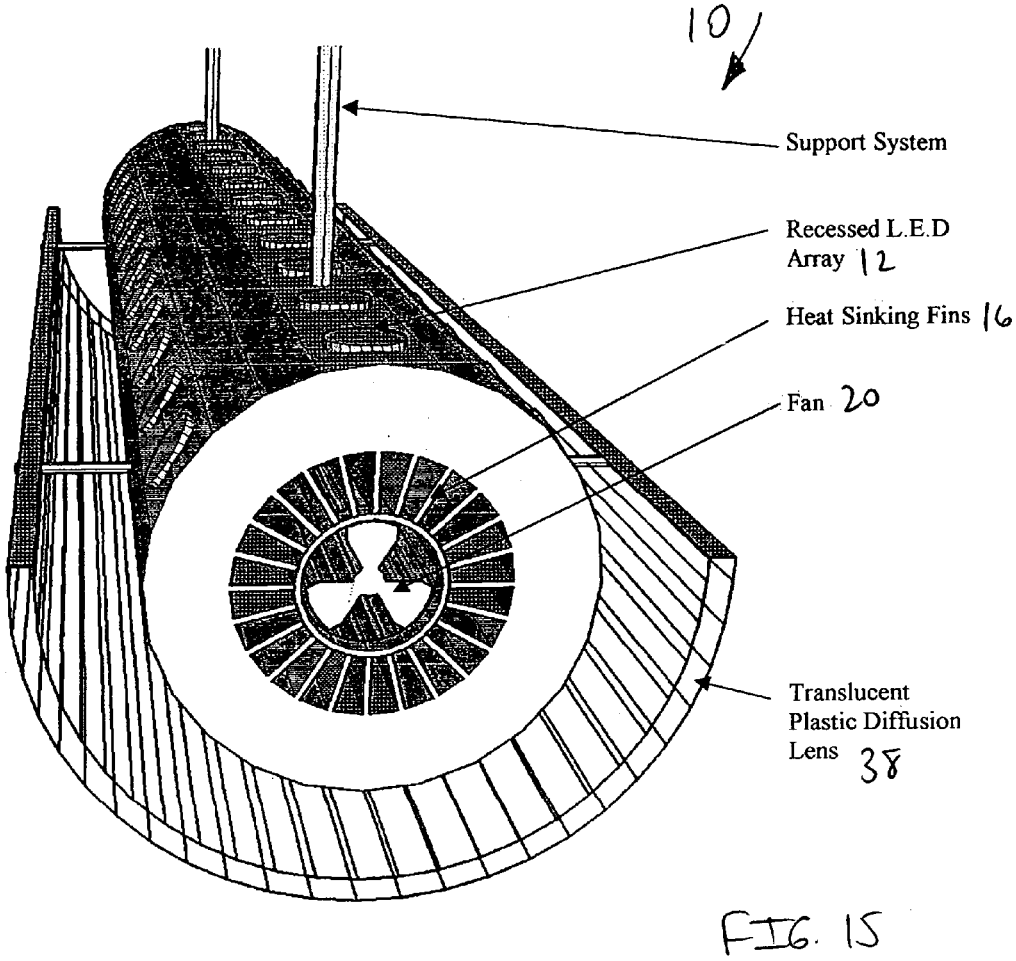
FIG. 15 is a perspective view illustrating the light emitting diode lighting fixture, constructed in accordance with the present invention, with three hundred and sixty (360°) degrees tube fixture.

As illustrated in FIG. 15, the tube implementation of the lighting fixture 10 can be oriented in any position for specific applications. Partial or full lens configuration and combinations can be incorporated with this invention. A partial diffusing lens 38, one hundred and eighty (180°) degrees facing down and around the L.E.D. fixture which would diffuse light downward reducing shadows and glaring irritating multiple light sources. The other one hundred and eighty (180°) degrees of L.E.D.'s 12 facing upwards would have no lens and would reflect off of room ceiling areas and reflect back into room diffusing shadows. A whole diffusing lens 38, 360 degrees around tube implementation could also be installed around this unit. This tube implementation can be populated a full three hundred and sixty (360°) degrees around tube with L.E.D.'s 12. The tube provides mechanical support, heat sinking, utility (power) delivery mechanism, and a pleasing aesthetic design. The tube can be hung with support wires or any support system or directly mounted to wall. A fan 20 can be added to the hollow center area to move air through the unit to cool the L.E.D.'s 12.

A trough with MR16 type reflector 40 with either, narrow or wide beam reflectors along the side walls of the trough with side emitter L.E.D.'s 12 installed on the bottom of trough. This trough can be attached to any type of heat transfer mounting bar 14 or heat-sink material.

Figure 16:
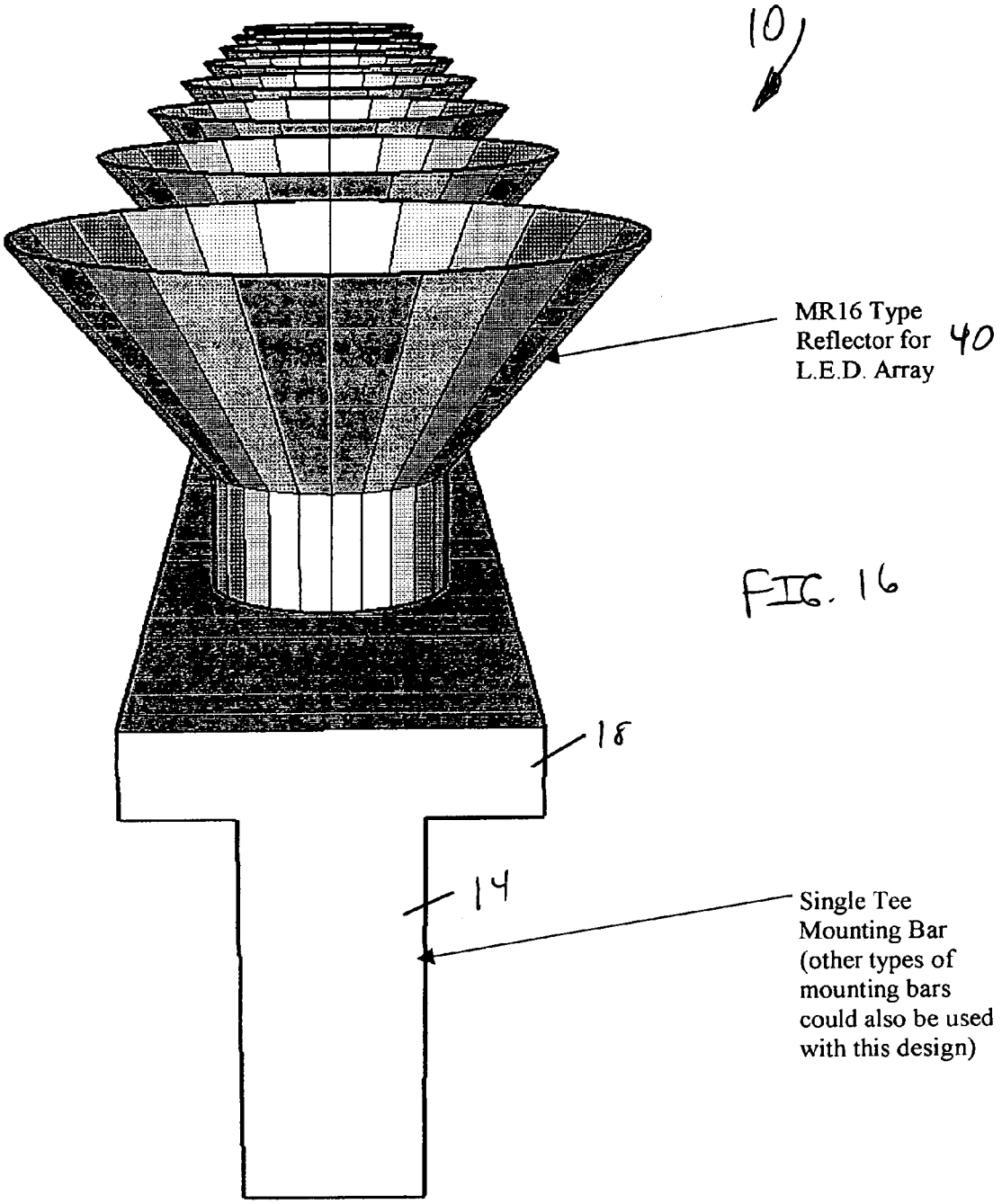
FIG. 16 is a perspective view illustrating the light emitting diode lighting fixture, constructed in accordance with the present invention, with a MR16 type reflector.

As illustrated in FIG. 16, the MR 16 type reflector 40 can have a L.E.D. 12 inside as a light source. This reflector can be attached to a mounting bar plate heat sinking and can also be recessed into an emitter plate.

Figure 17:
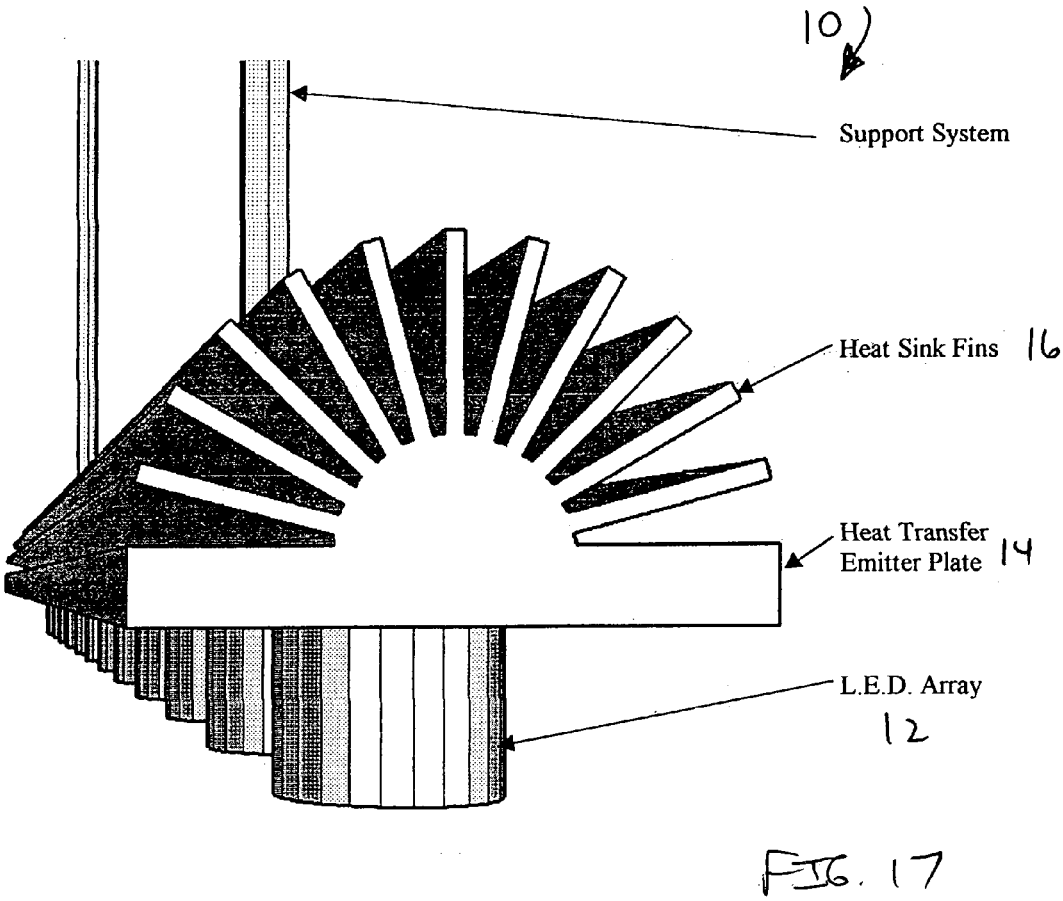
FIG. 17 is a perspective view illustrating the light emitting diode lighting fixture, constructed in accordance with the present invention, with an integrated heat sink design.

As illustrated in FIG. 17, any combination of L.E.D. population and heat sink configuration can be constructed with this implementation. Heat sink fins 14 could be added to increase the 180-degree radial heat sink fin configuration shown. Note: the heat sink fins 14 could also go higher than 180-degrees around the L.E.D.'s as needed.

Figure 18:
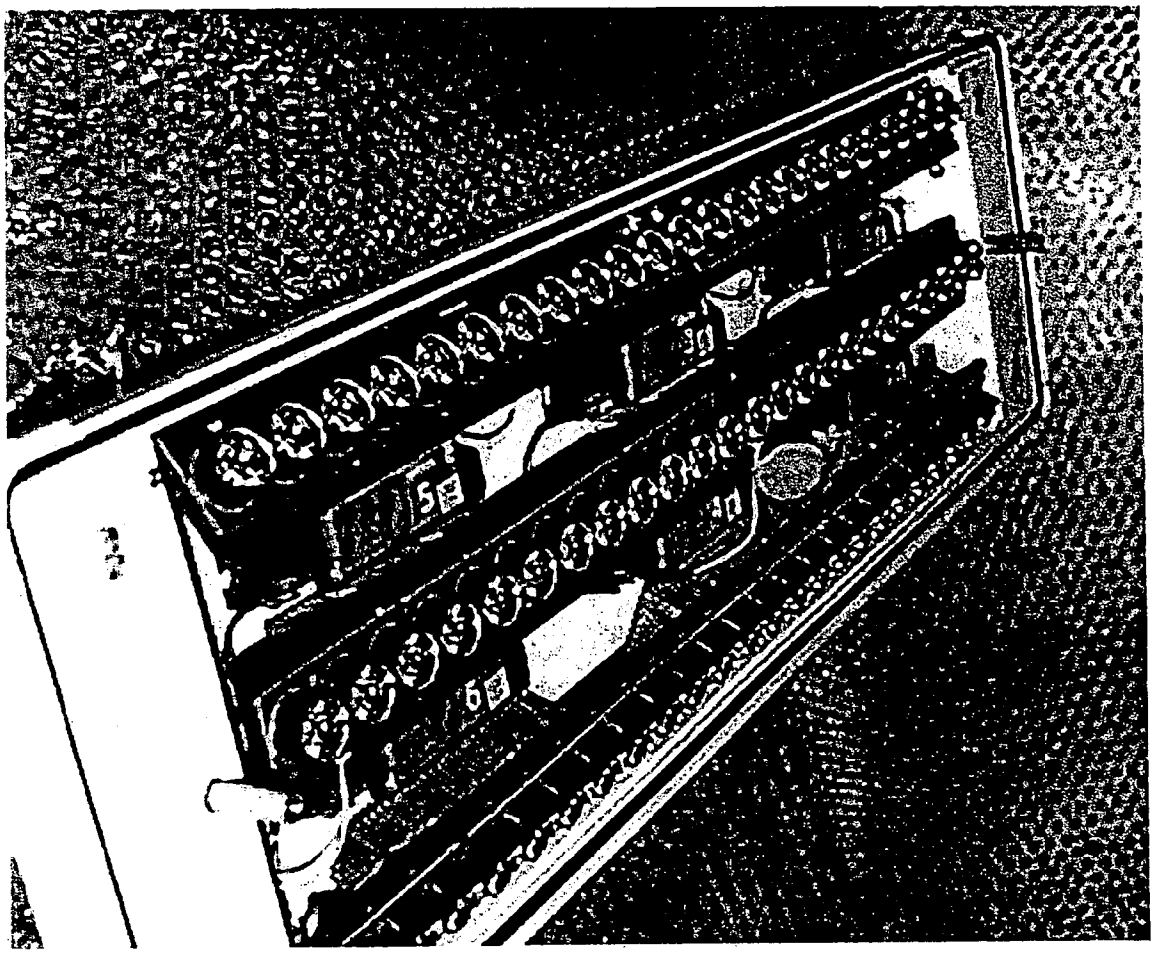
FIG. 18 is a perspective view illustrating an embodiment of the light emitting diode lighting fixture, constructed in accordance with the present invention.

As illustrated in FIG. 18, the L.E.D. lighting fixture 10 has a single tee set up with three bars cut at three different angles with heat sinks 14 all in one fixture. The lighting fixture 10 with all L.E.D.'s 12 on exceeds the lumen output of a comparable three F20 fluorescent bulb lighting fixture. With only half of the L.E.D.'s 12 on we were able to get 45 foot-candles at 5 feet with lens cover on. The three F20 bulbs with lens cover on only gave 27 foot-candles.

As illustrated in FIGS. 20–24, the lighting fixture 10 can include a multiple shadow reduction lens 42. The multiple shadow reduction lens takes a multiple light source as in the L.E.D. linear lighting fixture 10 creating multiple shadows and reducing the shadows. The sub-lens pattern within the multiple shadow reduction lens 42 takes the organized multiple light source patterns and creates chaos in the light patterns which reduces the shadows.

The sublenses can be arranged at different angles from, and not limited too, one (1°) degree to seventy (70°) degrees in different varying and random patterned degree angle arrays to create chaos in the individual focused L.E.D. light sources thus breaking up the shadows. In addition, the sub-lens can be of different types of lens arrays, such as a common prismatic type lens and further more the sub-lens cubes can vary in size depending on size, output, and distance from the L.E.D.s 12. Furthermore, the angle of the sublenses can be adjusted depending on the size, output, spacing, and distance from the L.E.D.s 12. Custom fitting of arrays of the sub-lens to any L.E.D. fixture would give the best results.

The L.E.D. lighting fixture 10 of the present invention addresses a number of problems including, but not limited to, mercury on nuclear vessels, breakage of normal light filaments during explosions or shock, the presence of ultraviolet light that degrades plastics over time, maintenance issues, interrupted light source with unreliable battery back-up, and high energy consumption, all of which are above and beyond normal fluorescent lighting used in Navy Subs and surface ships and any application where normal lighting and/or combined with emergency lighting highly resistant to explosion or shock is needed.

CONCLUSION

The L.E.D. (Light Emitting Diode) lighting fixture 10 has been developed as an alternative light source, capable of replacing typical fluorescent and incandescent fixtures. L.E.D.'s inherently emit either a direct highly concentrated beam spread or a diffuse light with extremely low lumens. The L.E.D. 12 array of the present invention is configured so that the light fixture emits a direct wide beam spread similar to the output of existing fluorescent and incandescent fixtures.

The L.E.D. lighting fixture 10 has been developed to be part of an emergency lighting system that can withstand extreme stresses, be reliable, and have a long life. It has been demonstrated that it is critical to an emergency lighting system to include the use of L.E.D.'s 12 made with a scotopically rich primary color. Increasing the eye's ability to respond to low levels of light could be critical to a person's ability to react in an emergency situation. Also, the primary scotopic color of L.E.D.'s 12 in this preferred system prepares the eye to respond and adapt quickly to changes in footcandles of light when the emergency lights come on.

L.E.D.'s typically have a lower lumen per watt output than fluorescent or incandescent lamps. Using L.E.D.'s 12 with a higher scotopic output increases perceived light, visual acuity and response of the eye under typically low lumen output L.E.D.'s The designs of the present application address a number of problems including: mercury on nuclear vessels, breakage of normal light filaments during explosions or shock, the presence of ultraviolet light that degrades plastics over time, maintenance issues, interrupted light source with unreliable battery back-up, and high energy consumption, all of which are above and beyond normal fluorescent lighting used in Navy Subs and surface ships and any application where normal lighting and/or combined with emergency lighting highly resistant to explosion or shock is needed. Another problem addressed with this design is multiple shadows which are more pronounced with multiple L.E.D.'s and stronger lumen output L.E.D.'s. A novel shadow reduction lens with sub-lens helps reduce the shadowing problem and also helps keep up the lumen output of the fixture The use of scotopic/photopic blends and ratios help maximize eye to lumen response and photochemical and transient adaptation to darkness in emergency situations. The scotopic range of light can be adjusted to reduce melatonin levels depending on desired effects of performance of occupants of an environment. For example the $3^{rd}$ shift in a motor room or industrial application where a higher ratio, for example 50% blue between 420–490 nm and 50% white, could be increased to lower melatonin levels therefore keeping $3^{rd}$ shift workers awake longer, depending on building design features including ceiling height and reflectivity of surfaces.

The L.E.D. lighting fixture 10 configure arrays of L.E.D.'s 12 so that light is spread out evenly and more closely matches the footcandle output and footcandle spread for a full 180 degrees or beam spread as required for each application.

The L.E.D. lighting fixture 10 address a problem with temporary lighting used for example in construction or in mines where light fixtures are strung up in an area and not securely fastened and fixtures have been known to fall. There have been a number of instances of fatal shock that have occurred with high voltage lighting. The new L.E.D. lighting fixture 10 can be run on either high or low voltage therefore reducing or eliminating shock hazard. Also, the internal metal framing structure, which holds the L.E.D.'s 12, has special anodized coatings to make them non-conductive further insulating people from shock hazard.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A lighting fixture, the lighting fixture comprising:
at least one heat transfer mounting bar;
at least one emitter plate secured to the mounting bar;
an array of L.E.D. lights secured to each emitter plate;
a plurality of mounting bars, the mounting bars creating air channels between each adjacent mounting bar;
a fixture body, the mounting bars and L.E.D. arrays mountable within the fixture body;
a lens cover mounted to the fixture body over the mounting bars and L.E.D. arrays; and
at least one fan mounted in the fixture body for forcing air through the air channels.

2. The lighting fixture of claim 1 wherein the beat transfer mounting bar is angled.

3. The lighting fixture of claim 1 wherein at least one of the emitter plates is angled.

4. The lighting fixture of claim 3 wherein the angle of each angled emitter plate is selected from the group consisting of side emitting and forward emitting with or without directional lens.

5. The lighting fixture of claim 1, and further comprising:
multiple angled emitter plates secured to the mounting bar.

6. The lighting fixture of claim 1 wherein the thickness of the air channels are determined by the generated heat.

7. The lighting fixture of claim 1, and further comprising:
a first fan for introducing air into the fixture body; and
a second fan for exhausting air from the fixture body.

8. The lighting fixture of claim 1 wherein the air channels are staggered inhibiting exhaust air from entering the inlet of adjacent fixtures.

9. The lighting fixture of claim 1 wherein the lens cover is a prismatic lens cover for diffusing the light evenly in all directions.

10. The lighting fixture of claim 1 wherein the lens cover is a diffusion lens mounted over the L.E.D. array.

11. The lighting fixture of claim 10 wherein the diffusion lens is configured in a substantially arch configuration.

12. The lighting fixture of claim 1 wherein the preferred L.E.D. provides light in the 400–620 nm range.

13. The lighting fixture of claim 1 wherein the Color Rendering Index (CRI) for photopic vision is between approximately fifty (50) and approximately ninety-five (95).

14. The lighting fixture of claim 13 wherein the Color Rendering Index (CRI) is approximately 85 or greater.

15. The lighting fixture of claim 1 wherein the Kelvin correlated color temperature in the photopic/scotopic spectrum can range between approximately 3,000° K. and 10,000° K.

16. The lighting fixture of claim 15 wherein the correlated color temperature is approximately 7,500° K. super daylight range with a 2.50 scotopic to photopic ratio.

17. A method for providing light, the method comprising:
providing at least one heat transfer mounting bar;
securing at least one emitter plate to the mounting bar;
securing an array of L.E.D. lights to each emitter plate;
creating air channels between each adjacent mounting bar;
providing a fixture body;
positioning the mounting bars and L.E.D. arrays within the fixture body;
mounting a lens cover to the fixture body over the mounting bars and L.E.D. arrays; and
mounting at least one fan in the fixture body for forcing air through the air channels.

18. The method of claim 17, and further comprising:
angling the heat transfer mounting bar.

19. The method of claim 17, and further comprising:
angling at least one of the emitter plates.

20. The method of claim 19 wherein the angle of each angled emitter plate is selected from the group consisting of side emitting and forward emitting with or without directional lens.

21. The method of claim 17, and further comprising:
securing multiple angled emitter plates to the mounting bar.

22. The method of claim 17, and further comprising:
determining the thickness of the air channels by the generated heat.

23. The method of claim 17, and further comprising:
introducing air into the fixture body; and
exhausting air from the fixture body.

24. The method of claim 17, and further comprising:
staggering the air channels; and
inhibiting exhaust air from entering the inlet of adjacent fixtures.

25. The method of claim 17, and further comprising:
diffusing the light evenly in all directions.

26. The method of claim 17 wherein the lens cover is a diffusion lens over the L.E.D. array.

27. The method of claim 26, and further comprising:
configuring the diffusion lens in a substantially arch configuration.

28. The method of claim 26, and further comprising:
blending the multiple light sources into one congruent light source, reducing shadows.

29. The method of claim 17, and further comprising:
providing light in the 400–620 nm range.

30. The method of claim 17, and further comprising:
providing the Color Rendering Index (CRI) for photopic vision between approximately fifty (50) and approximately ninety-five (95).

31. The method of claim 30 wherein the Color Rendering Index (CRI) is approximately 85 or greater.

32. The method of claim 17, and further comprising:
providing the Kelvin correlated color temperature in the photopic/scotopic spectrum range between approximately 3,000° K. and 10,000° K.

33. The method of claim 32 wherein the correlated color temperature is approximately 7,500° K. super daylight range with a 2.50 scotopic to photopic ratio.

* * * * *